US005262208A

United States Patent [19]

Krapivina et al.

[11] Patent Number: 5,262,208

[45] Date of Patent: Nov. 16, 1993

[54] GAS PLASMA TREATMENT FOR ARCHIVAL PRESERVATION OF MANUSCRIPTS AND THE LIKE

[75] Inventors: Svetlana A. Krapivina; Georgy Z. Paskalov; Alexander K. Filippov, all of St. Petersburg, U.S.S.R.

[73] Assignee: Plasma Plus, Los Angeles, Calif.

[21] Appl. No.: 864,435

[22] Filed: Apr. 6, 1992

[51] Int. Cl.[5] ..... B05D 1/04; B05D 3/04; B05D 7/06; B05D 3/10

[52] U.S. Cl. ..... 427/491; 427/569; 427/255.1; 427/255.2; 427/255.6; 427/391; 427/536; 427/488

[58] Field of Search ..... 427/569, 255.1, 255.2, 427/255.6, 391, 491, 536, 488; 428/542.4; 252/388, 399

[56] References Cited

U.S. PATENT DOCUMENTS 3,944,709 3/1976 Levy ..... 427/569
4,188,426 2/1980 Auerbach ..... 427/490
4,696,830 9/1987 Obayashi et al. ..... 427/41
5,156,882 10/1992 Rzad et al. ..... 427/569 X

FOREIGN PATENT DOCUMENTS 0177364 4/1986 European Pat. Off. .
62-132940 6/1987 Japan .
63-075002 4/1988 Japan .
1158634 5/1985 U.S.S.R. .

*Primary Examiner*—W. J. Shine
*Assistant Examiner*—Douglas J. McGinty
*Attorney, Agent, or Firm*—Natan Epstein

[57] ABSTRACT

Archival materials including paper manuscripts are preserved by a thin protective polymer film applied to the surface of the item by plasma polymerization of an organic monomer gas in a high frequency glow discharge. The polymer film protects the item against humidity and prevents widening of stroke lines due to ink spreading on the document. Microorganism growth is stopped by pretreatment of the document in a monoatomic gas plasma.

13 Claims, 1 Drawing Sheet

GAS PLASMA TREATMENT FOR ARCHIVAL PRESERVATION OF MANUSCRIPTS AND THE LIKE

FIELD OF THE INVENTION

This invention relates to archival conservation of materials including manuscripts on paper, and more particularly is directed to gas plasma treatments for application of protective polymer films to archival documents and for neutralizing potentially damaging microorganisms on such documents.

BACKGROUND OF THE INVENTION

It is known to preserve manuscripts by application of a polymer coating. Currently practiced methods of coating a paper surface with such a film involve at least seven distinct stages:

synthesis of a monomer;

polymerization of the monomer with formation of intermediate or end polymer;

preparation of a film forming solution;

cleaning of the surface or application of a bonding agent to the surface;

application of the coating;

drying of the coating;

solidification of the coating.

The basic disadvantages of these methods include the large number of stages involved in the process as well as unevenness and excessive thickness of the resultant coating, which leads to a change in the appearance of the object being preserved.

Another known approach to the archival preservation of documents and archaeological materials is the Parylene treatment method developed by Union Carbide. Parylene has come to be known as the generic term for a family of polymers derived from common xylene—the polyparaxylylenes. They are the only polymer group which forms in a vacuum from a true gas phase. Parylene comes to the end user in the dimeric form, as a free-flowing powder. This material must be converted to the final polymeric form within a special vacuum deposition system. Stages required to apply a coating to a paper surface using the parylene method include:

The dimer, when placed in a vacuum and heated to about 120 deg. C., begins to sublime, forming dimeric parylene gas.

In a pyrolysis zone the dimeric gas molecule is split into two reactive monomer molecules by the 650–690 deg. C. temperature.

Pressure forces the monomer gas through a pyrolysis zone and out into a deposition chamber (at room temperature).

The monomer molecules pick up very high kinetic energy during their passage through the heated zones. As a result, they bounce around the chamber hundreds to thousand of times before losing enough energy to absorb and polymerize on a surface within the chamber. This growth process results in long chains (linear polymer) that do not cross-link.

This method is characterized by polymerization beneath as well as on the surface of the growing film. The polymerization process occurs at essentially ambient temperature and there is no liquid phase, solvents or plasticizers. (Paper Strengthening with Gas-Phase Parylene Polymers: Practical Considerations.; Humphrey B., Restaurator 11: 1990, Munksgaard, Copenhagen).

The structure of the molecule and the high kinetic energies imparted during the process result in deep penetration into porous substances. The gas phase nature of the process as well as the growth from a molecular scale give unparalleled conformity of coating even on very complex substrates.

These characteristics make this material suitable for conservation applications ( The application of parylene conformal coating technology to archival and artifact conservation; Humphrey, B., Studies in Conservation 22 (2): August, 1984).

However, the process is generally not reversible on most substrates, particularly paper. The coating material is not soluble and forms a tight bond to most substrates, making removal difficult, if not impossible (Humphrey B: Y. Am. Ass. Cons. Hist. Art. Wks, 1986, v. 25 (2) pp. 15–22). The net result of the process is a new material that is no longer purely paper. What is produced is a parylene-cellulose composite with entirely different physical properties. The new material still has the same general appearance of paper but now, in addition, has the properties of parylene as well.

The parylene-cellulose composite is extremely resistant to chemical attack by all organic and inorganic chemicals at ambient temperature. The paper is extremely hydrophobic and can withstand total immersion in water for years with no damage to print or paper. The parylene-cellulose composite has reduced permeability to water vapor and harmful gases, i.e. $H_2S$, $SO_2$, and Cl.

Parylene changes the appearance of the paper thus destroying the historical value of the document being preserved. Specifically, paper tends to become somewhat more shiny in appearance;

paper treated with parylene tends to feel slippery, because of the dry film lubricity of the material. In this respect, it is similar to Teflon;

documents treated with parylene have areas with faint rainbow-colored patterns which indicate localized areas of film thinning caused by extreme challenges to gas penetration;

papers with heavy applications of parylene (12 μm or more) sometimes develop a rough texture or feel;

some color shade changes can occur in parylene-treated papers.

Once treated, Parylene technology does not allow further restoration of the archive documents. An additional disadvantage of the method is that it involves multiple stages.

Plasma polymerization techniques have been used in the past for certain applications unrelated to the objectives of this invention.

Japanese patent 63-75002 described treatment in an impulse or pulsed discharge in an atmosphere comprising the gases $CH_4$, $C_2H_6$ or $C_4H_{10}$ for increasing the durability and thermal stability of ferromagnetic layers of magnetic tapes. This method cannot be applied to the preservation of manuscripts and the like because the film formed during the process changes the appearance of the treated surface.

Another prior method of achieving film plasma polymerization, described in U.S. Pat. No. 4,188,426, includes treatment in a glow discharge of per-fluoro-cyclo-butane or hexafluoroethane to reduce the friction coefficient and to improve the surface hydrophobia of organic and inorganic substrates (e.g. polyethylene films, metals). This method also cannot be applied to conservation of manuscripts because the film formed during the process changes the appearance of the treated surface. In addition, the use of fluoro-containing monomers is contraindicated by ecological considerations.

A known method of water and oil repellent finishing of textiles, described in USSR Patent 1,158,634, includes plasma treatment in a glow discharge in an atmosphere of inorganic gases, followed by treatment with a fluoro containing acrylic monomer in gas phase . The first stage of the process can cause additional destruction of archival documents when the documents interact with the gas that creates the plasma. The second stage forms too rough a film.

Another prior method of plasma formation of a thin film on the surface of polymer material, described in Japanese Patent 62-132940, includes:

1. plasma treatment in a glow discharge in an atmosphere of $H_2$, CO, $N_2$, $O_2$ gases;
2. plasma polymerization; and
3. treatment in plasma of hydrogen.

The first stage is used to improve adhesion of the film surface for the subsequent polymerization stage. This first stage lasts from 20 sec to 30 minutes of time and can cause additional destruction of archive documents when the documents interact with the gas that creates the plasma.

What is needed is a conservation method for use on materials such as paper manuscripts which do not alter the appearance nor physically damage the item being preserved, which involves a minimum of processing of the item, which can be safely used on various materials, which is not ecologically damaging, and which is simple and reliable.

SUMMARY OF THE INVENTION

An objective of the present invention is the conservation of archival materials by plasma polymerization on the surface of the material. The polymer coating achieved by the novel method features preservation of the look as well as preservation of the physical and mechanical properties of the archival materials.

A pretreatment stage inhibits development of microorganisms present on the archival materials by exposure of the materials to a monoatomic gas plasma, such as Argon gas plasma, for a pretreatment time period sufficient to neutralize growth of the microorganisms.

More specifically, the polymerization on the surface of the document to be protected takes place in a low temperature plasma preferably under the following parameters of the plasma generating electric discharge:

generator frequency 1 to 40 MHz
pressure 0.01 to 10 Torr
specific discharge power 0.003 to 3 wt/cm$^3$
treatment times—30 to 3600 sec.

The treatment parameters should be kept within the ranges indicated. Otherwise, a hydrophobic surface effect will not be achieved, or the physical and chemical characteristics of the material being treated will be affected, leading to damage or inadequate preservation of the archival materials.

Tables 1 and 2 together with the Examples which follow illustrate the improved method of this invention.

DESCRIPTION OF THE PREFERRED EMBODIMENTS

Figure 1:
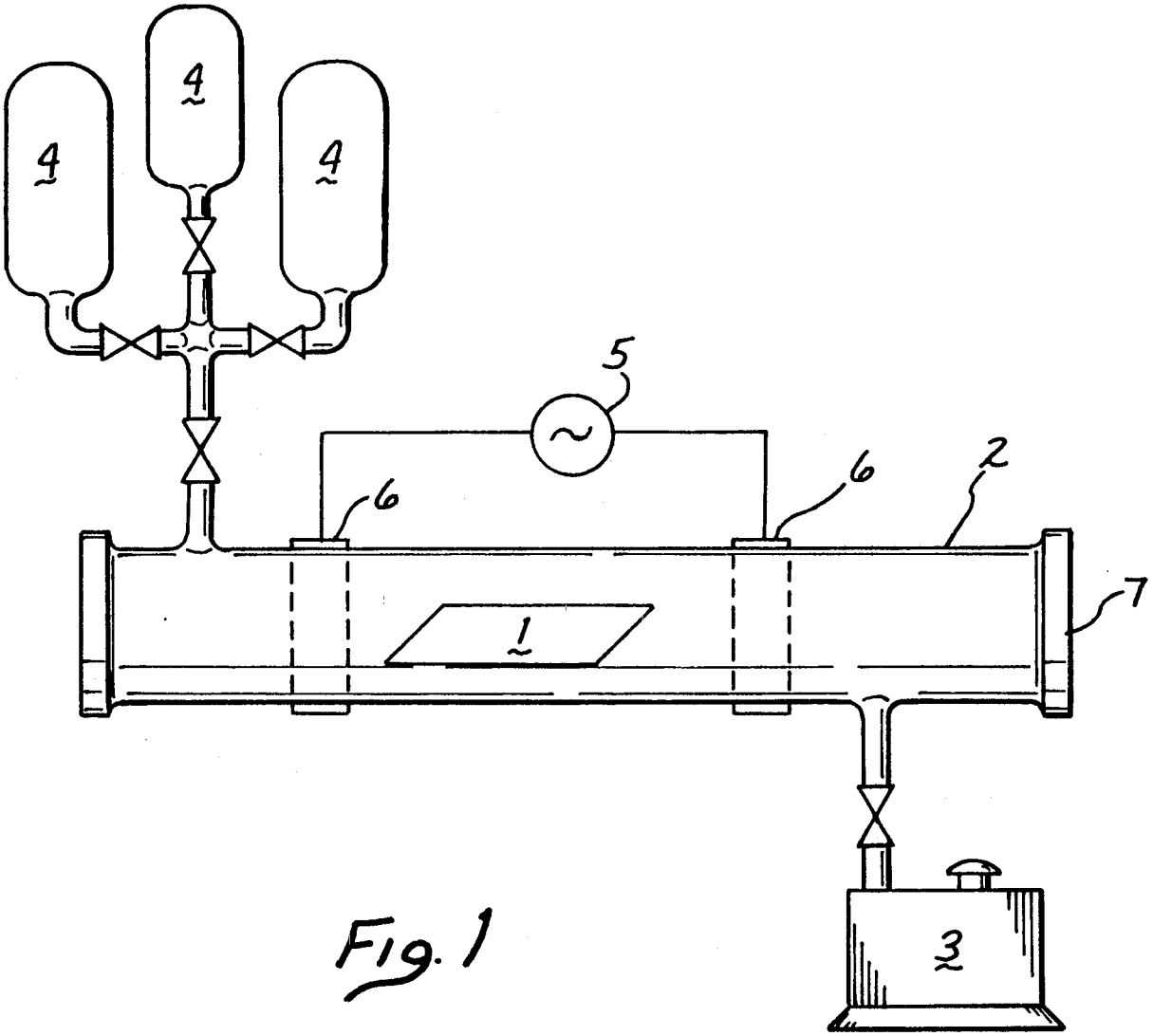
FIG. 1 is a schematic illustration of a low pressure gas plasma chamber used for material treatment according to the improved processes of this invention.

Many shortcomings and disadvantages of the prior art can be overcome if the paper surface is covered with a polymer film by plasma polymerization in a low temperature low pressure gas plasma. The following results can then be achieved:

1. Appearance of historical documents is preserved.
2. Ink smearing is avoided.
3. Original physical and mechanical properties of the documents remain unchanged.

In coatings applied by plasma polymerization the several stages of polymer formation in the methods mentioned above are replaced by a single stage. Relatively simple compounds which cannot be polymerized by conventional methods can be used as the starting monomer gas. Organic monomers may include $CH_4$, $C_3H_8$, $C_4H_{10}$, etc., and generally one or more hydrocarbon gases characterized by the formula $C_xH_y$ or a mixture of such gases. On the whole, plasma polymerization includes processes occurring in the gaseous phase (i.e., in the plasma volume), and processes taking place on the surface being treated.

In electrical glow discharges generated under low pressure, the main activation process involves collisions of free electrons accompanied by dissociation of the monomer:

$$CH_4+e \rightarrow CH_3+H+e$$

$$CH_4+e \rightarrow CH_2+H_2+e$$

and by ionization of the formed free radicals:

$$CH_3+e \rightarrow CH_3^{+}+2e$$

$$CH_2+e \rightarrow CH_2^{+}+2e$$

Under low pressure conditions the main recombination process involves surface phenomena. Energy is released in the course of recombination, including kinetic energy of the ions and the ionization energy of the same. The energy released leads to the formation of so-called growth centers on the surface being treated:

$$\text{surface } e+CH_3^{+} \rightarrow CH_3+\text{growth center}$$

Formation of polymer film on the surface can be described by the following reactions:

$$\text{Growth center}+CH_3 \rightarrow \text{polymer}$$

$$\text{Growth center}+CH_2 \rightarrow \text{polymer}+\text{growth center}$$

Formation of the polymer can be understood to include formation of the building blocks in the gas phase, and completion of polymer formation on the surface being treated.

Use of methane alone as the plasma gas leads to formation of a polymer film on the surface consisting of considerably branched carbon chains, which results in certain specific surface properties. It is important to this type of treatment that the new surface characteristics obtained be stable over long periods of time.

Films formed by methane plasma polymerization are characterized by high adhesion to the substrate. This is attributed to the absence of reaction capable groups in methane, which results in the plasma polymerization proceeding at a relatively slow rate.

Films formed by methane plasma polymerization are characterized by high adhesion to backings, by low permeability to air and water, and strong hydrophobic properties. For 1000 Angstrom film thickness, the permeability is $7.57\times10^{-13}$ $cm^3/cm^2$ sec.cm.h.c. That is significantly lower than the permeability of polymer films obtained by conventional methods (polyethylene—$9\times10^{-9}$; polyvinilchloride—$5\times10^{-11}$).

With reference to FIG. 1, the method disclosed here generally entails the following steps. The sample of paper to be processed 1 is placed in the chamber 2. The chamber is then evacuated with vacuum pump 3 until its interior pressure reaches 0.01 Torr. The vacuum system is then flushed with methane gas supplied from gas container 4, and then it is again evacuated. Additional methane gas is fed to the chamber to a pressure of from 0.01 to 10.00 Torrs. A high frequency (R.F.) power generator 5 connected to electrode 6 light an electrical glow discharge in the chamber between the electrodes. The specific power of the discharge is between 0.003 and 3 $wt/cm^3$. The treatment time of the paper sample 1 is between 30 and 3600 seconds. Then both the vacuum pump and the generator are turned off. The chamber is brought to atmospheric pressure and the sample is removed by opening the end closure 7.

Comparison of three types of before and after plasma-chemical treatment showed that the strength characteristics of the samples are practically unaffected by the thin polymer layer deposited on their surface. The strength characteristics of treated samples were found substantially unchanged after thermal and ultraviolet aging of the samples. Deformation characteristics of initial and treated paper samples were found to be practically the same. Consequently, application of a thin polymer layer does not affect strength and deformation characteristics of the paper substrate, but leads, however, to virtual loss of capillary absorption of the treated material.

The protective effect of the coating, formed as a result of plasma polymerization on the paper surface, was tested by measuring the resistance to spreading of ink writing made before coating on the paper surface during heat-moisture aging of the document. In addition, the polymer film coating applied according to this invention is effective in increasing the fungistatic effect of the treated paper, by preventing growth of micromycetes, among other microorganisms.

EXAMPLE 1

A 150×150 mm sample of newsprint paper (containing sulphate non-bleached cellulose—25%, white pulp mass—75%, filler—not more than 5%) was placed in a discharge chamber with external cylindrical electrodes. Air was evacuated from the chamber by the vacuum pump to pressure of 0.005 Torr. Methane was introduced into the chamber to a pressure of 0.5 Torr. A glow discharge was ignited by supplying high frequency voltage (13.57 MHz) to the electrodes with specific discharge power of 0.65 $Wt/cm^3$ for 360 sec.s. The discharge was then extinguished and vacuum pumping of the chamber was stopped. Air was admitted into the chamber and the sample removed from the discharge unit. The sample was subjected to testing after the plasma treatment and the following characteristics of the sample were tested by methods known and accepted in the paper industry:

tensile strength and elasticity;
resistance to rupture;
deformation in the wet state; and
whiteness or spherical photometer.

Paper durability was estimated according to the stability of its strength characteristics following thermal aging (at T=100+3 deg.C.) for 30 days and ultra violet radiation on both sides of the sample under a UV lamp for 60 minutes.

Comparison of strength and deformation characteristics of treated paper samples, before and after thermal and UV aging, showed that these characteristics were not affected by the thin polymer layer. However a virtual loss of capillary absorption of the material was found to result from the plasma polymerization treatment. The original capillary absorption of the untreated sample was determined to be 49 mm/10 min. The treated sample was found to have no measurable absorption. The wetting angle of the treated sample was measured as 103 degrees. These hydrophobic properties of the treated material were unchanged after the sample was kept immersed in water for one month.

EXAMPLE 2

A sample of typographic paper (containing sulphite bleached cellulose—80%, filler—18-23%, glue—not more than 0.5%) was placed in a discharge chamber between flat parallel electrodes, and treated under the conditions indicated in Example 1, but with the specific power of electrical discharge adjusted to 2 $Wt/cm^3$ and a treatment time of 60 seconds.

The time of absorption of a water drop for the untreated sample was 135 sec. Treated sample had no measurable capillary absorption. The wetting (contact) angle of the treated sample was 102 degrees. After thermal and UV aging these characteristics were found to be unchanged.

Testing showed that mechanical strength and deformation properties of the treated sample were undiminished by thermal and UV aging of the sample. The thin polymer film formed on the paper surface by the plasma treatment turns out to be protective against ultraviolet radiation and prevents damage to the archival documents from exposure to humidity and light.

EXAMPLE 3

The effect of the coating, formed as the result of plasma polymerization, on the tendency of ink line thickness to spread as a result of heat and moisture aging of the document was tested.

Text was written with violet-colored ink by means of an ink-pen on sample sheets of sulphite paper (containing sizing agents: high-resin glue—0.5%; alumina—0.5%; cooling filler—25%). Every sheet was cut into two halves. One half served as the control sample, while the second half was placed into the discharge chamber with external cylindrical electrodes, and treated under the conditions indicated in Example 1, but the specific power of electrical discharge adjusted to 0.75 $Wt/cm^3$ and treated for a time of 360 sec, to apply a thin polymer coating to the surface of the paper.

The samples, both control and plasma-treated halves, were placed in a chamber for heat and moisture aging.

Resistance of the ink text to spreading was estimated by the stability of stroke width. The width of the text letters' strokes was measured under a microscope. Ten letters in various parts of the sheet were selected, and the stroke width was measured in one and the same place before and after heat aging.

Variations in the width of the letters' strokes after thermo-wet aging for 72 hours at 30 degrees C. was found to be:

for control sample—22.5 micrometers.
for treated sample—0.0

EXAMPLE 4

Archived documents can be damaged or destroyed as a result of growth of microorganisms, such as micromycetes. The surface films obtained by plasma polymerization tend to suppress growth of micromycetes and development of micromycete spores, and therefore provide fungistatic protection of the treated document. Substantially complete protection of archival documents against microorganisms can be obtained by a two stage process as follows:

1. Treatment of a microorganism (e.g. micromycete) affected sample in a monoatomic gas plasma, preferably Argon plasma; followed by
2. Polymer coating by way of polymerization in an organic monomer plasma.

Spores on the sample surface are subjected to the kinetic and potential energy of Argon ions during the first treatment stage. The kinetic energy of the ions results from acceleration in a radial electric field inherently generated in the glow discharge. The potential energy of the Argon ions is equal to their ionization energy. In this first stage or pretreatment the glow discharge parameters are selected such as to neutralize the spores while preserving the properties of the document being treated, within the following parameter ranges:

generator frequency—1 to 40 MHz
pressure—0.01 to 10 Torr;
Specific discharge power—0.003 to 3.0 Wt/cm$^3$
Treatment time—from 10 to 60 seconds The second treatment stage prevents further development of any remaining spores and adds water repellent properties to the surface of the document. The combination of the two treatment stages permits documents to be preserved for prolonged time periods without change or damage.

Micromycete spores were fixed with an adhesive to the surface of a 50×50 mm sample of newsprint paper (containing sulphate non-bleached cellulose—25%, white pulp mass—75%, filler not more than 5%). The paper sample bearing the spores was then placed in the discharge chamber provided with external cylindrical electrodes, and treated under the conditions indicated in Example 1, but the specific power of the electrical discharge was adjusted to 2.0 Wt/cm$^3$ and the treatment time was 60 seconds.

Untreated and treated samples were placed in a suitable nutrient medium, and micromycete growth was measured in points. Micromycete growth in the untreated sample began from the first day in the nutrient medium and after twenty days it was 13 points. Micromycete growth in the treated sample never occurred The samples were under observation for 6 months.

TABLE 1

EFFECT OF TREATMENT TIME ON PROPERTIES OF PAPER

| | Specific Power Wt/cm3 | Time of Treatment, sec. | Time of Water Absorption, sec. | Variations On Width of Line in Micrometer* | Capillary Absorption mm/10 min | Wetting Angle, Degrees |
|---|---|---|---|---|---|---|
| Sulphate Paper | 0 initial | 0 | 13 | 85 | 42 | — |
| | 3.0 | 15 | 150 | 34 | 15 | 73 |
| | 3.0 | 20 | 1200 | 4.5 | 0 | 90 |
| | 3.0 | 30 | no absorption | 1.5 | 0 | 95 |
| | 3.0 | 60 | | 0 | 0 | 103 |
| | 3.0 | 3600 | | 0 | 0 | 105 |
| | 3.0 | 3600 | | 0 | 0 | 104 |
| | | | (The sample was placed in water for one month) | | | |
| | 3.0 | 3700 | no absorption | 0 | 0 | 105 |
| | | | | | | The appearance of treated sample is changed insignificantly |
| Sulphite Paper | 0 initial | 0 | 11 | 22.5 | 34 | — |
| | 3.0 | 15 | 180 | 8.5 | 9 | 81 |
| | 3.0 | 20 | 1350 | 3.0 | 0 | 93 |
| | 3.0 | 30 | no absorption | 0.5 | 0 | 98 |
| | 3.0 | 60 | | 0 | 0 | 104 |
| | 3.0 | 3600 | | 0 | 0 | 105 |
| | 3.0 | 3600 | | 0 | | |
| | | (The sample was placed) in water for one month) | | 0 | 0 | 102 |
| | 3.0 | 3700 | | 0 | 0 | 105 |
| | | | | | | The appearance of treated sample is changed insignificantly |
| Newsprint Paper | 0 initial | 0 | 14 | 48 | 49 | |
| | 3.0 | 15 | 210 | 1 | 9 | 85 |
| | 3.0 | 20 | 1440 | 0.5 | 0 | 94 |
| | 3.0 | 30 | no absorption | 0 | 0 | 103 |
| | 3.0 | 60 | | 0 | 0 | 105 |
| | 3.0 | 3600 | | 0 | 0 | 105 |
| | 3.0 | 3600 | (The sample was placed in water for one month) | | | |

TABLE 1-continued

EFFECT OF TREATMENT TIME ON PROPERTIES OF PAPER

| Specific Power Wt/cm3 | Time of Treatment, sec. | Time of Water Absorption, sec. | Variations On Width of Line in Micrometer* | Capillary Absorption mm/10 min | Wetting Angle, Degrees |
|---|---|---|---|---|---|
| | | | 0 | 0 | 104 |

*Variations in the width of the letters' strokes after thermo-wet aging for 72 hours at 30 degrees C.

TABLE 2

EFFECT OF PLASMA POLYMERIZATION PARAMETERS ON THE EXTERNAL MICROMYCETE GROWTH ON THE SURFACE OF THE NEWSPAPER PRINT

| Type of Micro-Mycetes | 1st Stage | Specific Power Wt/cm3 | Time of Treatment | Extent micromycete growth on time, balls | | | | |
|---|---|---|---|---|---|---|---|---|
| | | | | 3 days | 6 days | 10 days | 15 days | 20 days |
| *Aspergillus Niger* | – initial | 0 | 0 | 1.5 | 4.25 | 5.75 | 8.75 | 13 |
| | – | 2.0 | 600 | 0 | 0.25 | 0.75 | 1.5 | 2.5 |
| | + | 0 | 0 | 0.25 | 0.7 | 1.25 | 2.5 | 3.5 |
| | + | 2.0 | 30 | 0 | 0 | 0 | 0 | 0 |
| | + | 2.0 | 600 | 0 | 0 | 0 | 0 | 0 |
| *Aspergillus Flavus* | – initial | 0 | 0 | 1.5 | 4.2 | 5.7 | 8.7 | 13 |
| | – | 2.0 | 600 | 0 | 0 | 0.1 | 0.5 | 2.25 |
| | + | 0 | 0 | 0.2 | 0.6 | 1.1 | 2.2 | 3.0 |
| | + | 2.0 | 30 | 0 | 0 | 0 | 0 | 0 |
| | + | 2.0 | 600 | 0 | 0 | 0 | 0 | 0 |
| *Trichocherma Viride* | – initial | 0 | 0 | 1.5 | 4.2 | 5.7 | 8.6 | 12.6 |
| | – | 2.0 | 600 | 0 | 0 | 0 | 0.4 | 2.0 |
| | + | 0 | 0 | 0.1 | 0.4 | 0.9 | 1.9 | 2.5 |
| | + | 2.0 | 30 | 0 | 0 | 0 | 0 | 0 |
| | + | 2.0 | 600 | 0 | 0 | 0 | 0 | 0 |
| *Aspergillus Terreus* | – initial | 0 | 0 | 1.3 | 4.0 | 5.1 | 8.4 | 12 |
| | – | 2.0 | 600 | 0 | 0 | 0 | 0 | 0.25 |
| | + | 0 | 0 | 0.05 | 0.2 | 0.6 | 1.1 | 2.0 |
| | + | 2.0 | 30 | 0 | 0 | 0 | 0 | 0 |
| | + | 2.0 | 600 | 0 | 0 | 0 | 0 | 0 |

What is claimed is:

1. A method for preserving archival materials comprising the steps of:

exposing said materials to a low temperature plasma of organic monomer gas comprised of one or more hydrocarbon gases or a mixture thereof; and continuing said exposure for a treatment time ranging from 30 to 3600 seconds to form a thin layer of polymer material on the surface of said material.

2. A method for preserving archival materials, comprising the steps of:

pretreating said materials in a plasma of a monoatomic gas for a pretreatment time of between 10 seconds and 60 seconds to inhibit development of microorganisms present on said materials without significantly altering the physical properties of said materials; and then exposing said materials to a low temperature plasma of organic monomer gas for a treatment time ranging from 30 to 3600 seconds to form a thin layer of polymer material on the surface of said materials.

3. The method of claim 1 wherein said organic monomer gas is methane.

4. The method of claim 1, wherein said plasma is characterized by a pressure of 0.01–10 Torr.

5. The method of claim 4 wherein said plasma is generated by a power source of 1 to 40 MHz with a specific discharge power of 0.003 to 3.0 Wt/cm3.

6. The method of claim 2 wherein said organic monomer gas is comprised of one or more hydrocarbon gases or a mixture thereof.

7. The method of claim 1, further comprising the step of pretreating said materials in a plasma of a monoatomic gas prior to said step of exposing.

8. The method of claim 7, wherein said step of pretreating is carried out in a high frequency gas discharge at a pressure of between 0.01 to 10 Torr, a power input frequency of between 1 and 40 MgHz with a specific discharge power of between 0.003 and 3.0 Wt/cm$^3$, for a pretreatment time ranging from 10 sec to 60 sec.

9. The method of claim 2 wherein said organic monomer gas is methane gas.

10. The method of claim 2 wherein said steps of pretreating and exposing are carried out in a plasma gas discharge between electrodes.

11. The method of claim 2, wherein said step of pretreating is carried out in a high frequency gas discharge at a pressure of between 0.01 to 10 Torr, a power input frequency of between 1 and 40 MgHz with a specific discharge power of between 0.003 and 3.0 Wt/cm3.

12. A method for neutralizing microorganisms on archival materials and preserving the materials against humidity and ultraviolet radiation, comprising the steps of:

first exposing said materials to a lower temperature argon plasma at a pressure of between 0.01 to 10 Torr, a power input frequency of between 1 and 40 MgHz with a specific discharge power of between 0.003 and 3.0 Wt/cm$^3$, for a treatment time ranging from 10 to 60 seconds;

then exposing said materials to a low temperature plasma of methane gas generated by a power source of 1 to 40 MHz with a specific discharge power of 0.003 to 3.0 Wt/cm$^3$ at a pressure of 0.01 to 10 Torr for a treatment time ranging from 30 to 3600 seconds to form a thin layer of polymer material on the surface of said material.

13. The method of claim 2 wherein said monoatomic gas is argon gas.

* * * * *